US011118120B2

(12) United States Patent
Brown et al.

(10) Patent No.: US 11,118,120 B2
(45) Date of Patent: Sep. 14, 2021

(54) UPGRADING POLYNUCLEARAROMATIC HYDROCARBON-RICH FEEDS

(71) Applicant: ExxonMobil Research and Engineering Company, Annandale, NJ (US)

(72) Inventors: Stephen H. Brown, Lebanon, NJ (US); Samia Ilias, Bridgewater, NJ (US); Randolph J. Smiley, Hellertown, PA (US); Richard Demmin, Highland Park, NJ (US); Shifang Luo, Annandale, NJ (US); Brenda A. Raich, Annandale, NJ (US); Aldrin G. Cuevas, The Woodlands, TX (US); Keith Wilson, Weybridge (GB); Jesse R. McManus, Baton Rouge, LA (US); Lei Zhang, Basking Ridge, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 16/707,667

(22) Filed: Dec. 9, 2019

(65) Prior Publication Data

US 2020/0181509 A1 Jun. 11, 2020

Related U.S. Application Data

(60) Provisional application No. 62/777,392, filed on Dec. 10, 2018.

(51) Int. Cl.

| | |
|---|---|
| ***C10G 45/46*** | (2006.01) |
| ***C10G 47/02*** | (2006.01) |
| ***C10G 47/32*** | (2006.01) |
| ***C10G 49/06*** | (2006.01) |
| ***C10G 65/10*** | (2006.01) |
| ***C10G 67/02*** | (2006.01) |

(52) U.S. Cl.

CPC ..... *C10G 47/02* (2013.01); *C10G 67/02* (2013.01); *C10G 2300/1003* (2013.01); *C10G 2300/1074* (2013.01); *C10G 2300/1096* (2013.01); *C10G 2300/202* (2013.01); *C10G 2300/30* (2013.01); *C10G 2300/301* (2013.01); *C10G 2300/302* (2013.01); *C10G 2300/308* (2013.01); *C10G 2400/02* (2013.01); *C10G 2400/28* (2013.01)

(58) Field of Classification Search

CPC ..... C10G 45/46; C10G 47/02; C10G 47/32; C10G 49/06; C10G 65/10; C10G 2300/202; C10G 2300/301

See application file for complete search history.

(56) References Cited

U.S. PATENT DOCUMENTS

| | | | | |
|---|---|---|---|---|
| 3,166,489 | A * | 1/1965 | Mason | C10G 47/36 208/57 |
| 3,632,500 | A * | 1/1972 | Csicsery | B01J 23/44 208/60 |
| 4,764,266 | A * | 8/1988 | Chen | C10G 65/12 208/58 |
| 4,961,839 | A * | 10/1990 | Stine | C10G 47/00 208/102 |
| 5,364,514 | A * | 11/1994 | Sanborn | C10G 65/00 208/58 |
| 5,464,526 | A * | 11/1995 | Saunders | C10G 67/06 208/108 |
| 8,585,889 | B2 | 11/2013 | Kim et al. | |
| 8,691,076 | B2 | 4/2014 | Kim et al. | |
| 8,741,129 | B2 | 6/2014 | Brown et al. | |
| 9,090,835 | B2 | 7/2015 | Beech, Jr. et al. | |
| 9,102,884 | B2 | 8/2015 | Xu et al. | |
| 9,637,694 | B2 | 5/2017 | Evans et al. | |
| 9,657,239 | B2 | 5/2017 | Beech, Jr. et al. | |
| 9,765,267 | B2 | 9/2017 | Evans et al. | |
| 9,771,524 | B2 | 9/2017 | Xu et al. | |
| 9,777,227 | B2 | 10/2017 | Soultanidis et al. | |
| 9,809,756 | B2 | 11/2017 | Soultanidis et al. | |
| 10,000,710 | B2 | 6/2018 | Ferrughelli et al. | |
| 10,344,222 | B2 | 7/2019 | Agrawal et al. | |
| 2013/0081979 | A1 | 4/2013 | Brown et al. | |
| 2013/0233764 | A1 | 9/2013 | Brown et al. | |
| 2014/0061100 | A1 | 3/2014 | Lattner et al. | |
| 2014/0174980 | A1 | 6/2014 | Brown et al. | |
| 2015/0361359 | A1 | 12/2015 | Beech, Jr. et al. | |
| 2018/0057759 | A1 | 3/2018 | Kandel et al. | |
| 2018/0134965 | A1* | 5/2018 | Brown | C10G 69/04 |
| 2018/0134972 | A1 | 5/2018 | Brown et al. | |

(Continued)

FOREIGN PATENT DOCUMENTS

| | | | |
|---|---|---|---|
| WO | 2018111572 | A1 | 6/2018 |
| WO | 2018111574 | A1 | 6/2018 |

(Continued)

OTHER PUBLICATIONS

The International Search Report and Written Opinion of PCT/US2019/065408 dated Feb. 24, 2020.

*Primary Examiner* — Randy Boyer
(74) *Attorney, Agent, or Firm* — Robert A. Migliorini

(57) ABSTRACT

A method of upgrading refining streams with high polynucleararomatic hydrocarbon (PNA) concentrations can include: hydrocracking a PNA feed in the presence of a catalyst and hydrogen at 380° C. to 430° C., 2500 psig or greater, and 0.1 $hr^{-1}$ to 5 $hr^{-1}$ liquid hourly space velocity (LSHV), wherein the weight ratio of PNA feed to hydrogen is 30:1 to 10:1, wherein the PNA feed comprises 25 wt % or less of hydrocarbons having a boiling point of 700° F. (371° C.) or less and having an aromatic content of 50 wt % or greater to form a product comprising 50 wt % or greater of the hydrocarbons having a boiling point of 700° F. (371° C.) or less and having an aromatic content of 20 wt % or less.

10 Claims, 8 Drawing Sheets

(56) References Cited

U.S. PATENT DOCUMENTS

| | | | |
|---|---|---|---|
| 2018/0171239 | A1 | 6/2018 | Chen et al. |
| 2019/0016969 | A1 | 1/2019 | Kandel et al. |
| 2019/0016975 | A1 | 1/2019 | Coleman et al. |
| 2019/0127651 | A1 | 5/2019 | Kar et al. |
| 2019/0300803 | A1 | 10/2019 | Emanuele et al. |

FOREIGN PATENT DOCUMENTS

| | | | |
|---|---|---|---|
| WO | 2018111576 | A1 | 6/2018 |
| WO | 2018111577 | A1 | 6/2018 |
| WO | 2019/203981 | A1 | 10/2019 |

* cited by examiner

UPGRADING POLYNUCLEARAROMATIC HYDROCARBON-RICH FEEDS

CROSS-REFERENCE TO RELATED APPLICATIONS

This application claims priority to U.S. Provisional Application Ser. No. 62/777,392 filed Dec. 10, 2018, which is herein incorporated by reference in its entirety

BACKGROUND

The present disclosure relates to upgrading refining streams with high polynucleararomatic hydrocarbon (PNA) concentrations.

PNAs are aromatic hydrocarbons having 2 or more (preferably 2 to 15) aromatic rings. There is a need to upgrade streams with an appreciable concentration of PNA (e.g., greater than 1 wt % PNA). Examples of such streams include steam cracker tar (the 450+° F. (232+° C.) distillation bottoms produced from naphtha and vacuum gas oil steam cracking), FCC main column bottoms (MCB) (the 650+° F. (343+° C.) distillation bottoms produced from refinery fluid catalytic crackers), coal tar (the 400+° F. (204+° C.) distillation bottoms produced from steel industry coke ovens), coker tar (the 650+° F. (343+° C.) bottoms produced from delayed, fluid, and flexicokers), and heavy oil tar (the 900+° F. (482+° C.) bottoms produced by vacuum distillation of heavy oil). As used herein, the abbreviation of n° F.+ refers to a composition being composed of components having a boiling point of n° F. or greater. The most important single heavy oil resource is Canadian heavy oil or Canadian tar sands.

PNA is not soluble in waxy saturated hydrocarbons under traditional hydrocracking conditions, so PNA precipitates in refining processes, which plugs up machinery and cokes the catalyst. Accordingly, PNA concentrations in feedstocks for hydrocracking are limited to ppm levels. As a result, there is no economic pathway today to upgrade streams with appreciable concentrations of PNA into amounts of clean fuel products with any significant efficacy or efficiency. Most of these streams today are coked. Accordingly, by the time the tar or other starting material has been fully refined, over 20 wt % has been downgraded to coke and $C_{4-}$ paraffins.

SUMMARY

The present disclosure relates to upgrading refining streams with high polynucleararomatic hydrocarbon (PNA) concentrations.

A method of the present invention can comprise: hydrocracking a PNA feed in the presence of a catalyst and hydrogen at 380° C. to 430° C., 2500 psig or greater, and 0.1 $hr^{-1}$ to 5 $hr^{-1}$ liquid hourly space velocity (LSHV), wherein the weight ratio of PNA feed to hydrogen is 30:1 to 10:1, wherein the PNA feed comprises 25 wt % or less of hydrocarbons having a boiling point of 700° F. (371° C.) or less and having an aromatic content of 50 wt % or greater to form a product comprising 50 wt % or greater of the hydrocarbons having a boiling point of 700° F. (371° C.) or less and having an aromatic content of 20 wt % or less.

Another method of the present invention is a method comprising: hydrocracking a PNA feed in the presence of hydrogen and a base metal catalyst at 380° C. to 430° C., 2500 psig or greater, and 0.1 $hr^{-1}$ to 5 $hr^{-1}$ liquid hourly space velocity (LSHV), wherein the weight ratio of PNA feed to hydrogen is 30:1 to 10:1, wherein the PNA feed comprises 25 wt % or less of hydrocarbons having a boiling point of 700° F. (371° C.) or less and 2 wt % or greater sulfur and having an aromatic content of 50 wt % or greater to form a first product; separating the first product into an overheads stream and a 950+° F. (510+° C.) bottoms stream, wherein the overheads stream comprises 50 wt % or greater of the hydrocarbons having a boiling point of 700° F. (371° C.) or less and having an aromatic content of 20 wt % or less; distilling the overheads stream into a 700+° F. (371+° C.) boiling point stream having less than 15 ppm sulfur and one or more fractions selected from the group consisting of: a C4− paraffin stream comprising less than 15 ppm sulfur, a naphtha fraction having less than 15 ppm sulfur, and a distillate fraction having less than 15 ppm sulfur; and hydrocracking the 700+° F. (371+° C.) boiling point stream in the presence of hydrogen and a noble metal catalyst to form a second product.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
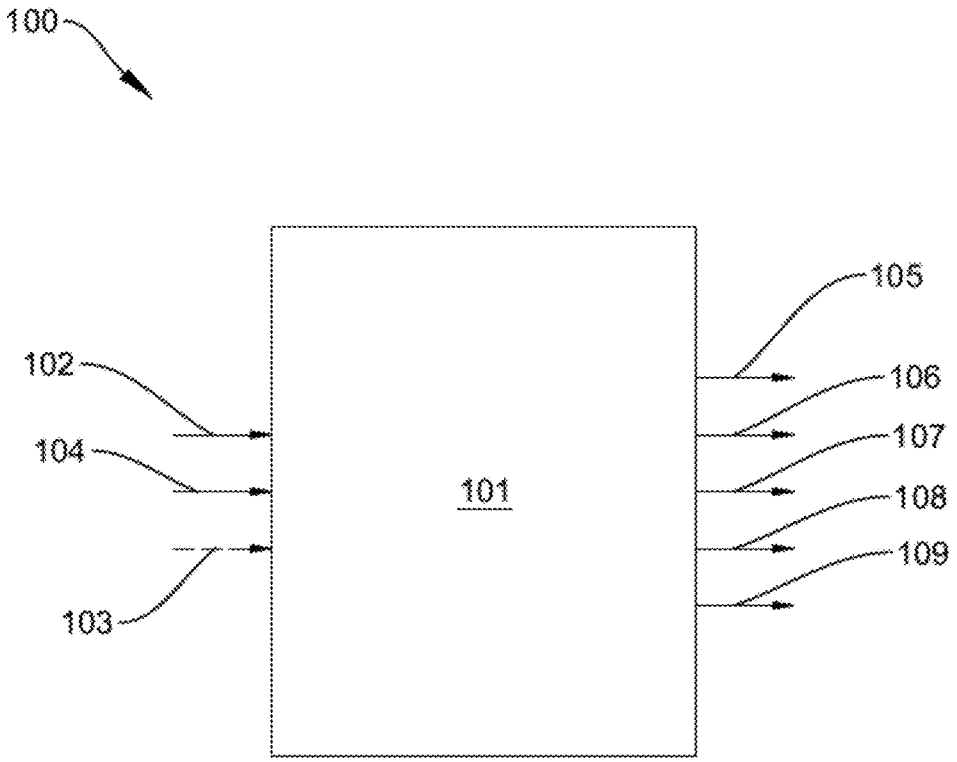
FIG. 1 is an illustrative diagram of an example process of the present invention.

The present invention relates to upgrading streams with appreciable amounts of PNA to produce valuable hydrocarbons like liquid petroleum gas (LPG), gasoline, and ultralow sulfur diesel (ULSD) in a single stage or, preferably, a two-stage hydrocracking reactor. More specifically, the PNA feed stream is hydrocracked under conditions that facilitate solvency of the PNA and other components in the stream.

As used herein, the terms "polynucleararomatic hydrocarbon" and "PNA" refer to hydrocarbons comprising fused aromatic rings that can optionally have side chains.

As used herein, the terms "polyaromatic hydrocarbon" and "PAH" refer to PNAs without any side chains. PAHs are a subclass of PNAs.

Without being limited by theory, PNA is highly insoluble in 650+ blends of paraffins, isoparaffins, and 1-2 ring naphthenes, but are soluble in aromatic cosolvents like long sidechain branched, 1-2 ring aromatics. Conventional hydrocracking technology selectively reacts away the aromatic cosolvents into either (a) a lower boiling range by cracking or (b) 1-2 ring naphthenes by aromatic hydrogenation reactions. Conventional hydrocracking catalysts simultaneously catalyze the production of high MW PNA and methyl and ethyl substituted PNAs. At high conversions, the PNA's precipitate into high viscosity sticky liquids or directly onto catalyst and equipment surfaces. Even ppm quantities of PNA precipitation can cause catastrophic catalyst and equipment failure within hours.

Generally, it is widely believed in the refining community that upgrading 3-ring aromatics like phenanthrene and anthracene to full saturation is not thermodynamically possible in the presence of 4+-aromatics. Further, it is widely held that the PNAs will coke under hydrocracking conditions. Additionally, the catalyst activity is believed to be insufficient for appreciable upgrading of 3+-ring aromatics. The process of the invention avoids this problem by controlling the feedstock, the catalyst, and the conditions in the reactor to maximize reaction medium solvency, minimize PNA production, and prevent PNA precipitation.

Regarding controlling the feedstock, the solvency of the components of the feedstock are considered. The solvency criterion of Wiehe (Wiehe and Kennedy, 2000a) requires titration of the individual oils with a model solvent (e.g., toluene) and a model non-solvent (e.g., n-heptane). This enables measuring the solubility parameter of the mixture at which PNAs precipitate. This solubility parameter on a reduced n-heptane-toluene scale is called the insolubility number ($I_N$). In addition, the tests measure the solubility parameter of the oil that on a reduced n-heptane-toluene scale is called the solubility blending number ($S_{BN}$). The criterion for solvency of any blend is that the volume average solubility blending number is greater than the maximum insolubility number of any component in the blend.

In order to mitigate PNA precipitation, an insolubility number ($I_N$) and a solvent blend number ($S_{BN}$) are determined for the components of the feedstock. Optionally, a solvent can be used to achieve the $I_N$ and $S_{BN}$ of the feedstock that mitigates PNA precipitation. Successful blending can be accomplished with little or substantially no precipitation by combining the components in order of decreasing $S_{BN}$, so that the $S_{BN}$ of the blend is greater than the $I_N$ of any component of the blend. U.S. Pat. No. 5,871,634, incorporated herein by reference, describes the method of calculating $I_N$ and $S_{BN}$.

PNA feed streams can have a $S_{BN}$ greater than 135 and a $I_N$ greater than 100. Examples of PNA feed streams include, but are not limited to, steam cracker tar (the 450+° F. (232+° C.) distillation bottoms produced from naphtha and vacuum gas oil steam cracking), FCC main column bottoms (MCB) (the 650+° F. (343+° C.) distillation bottoms produced from refinery fluid catalytic crackers), coal tar (the 400+° F. (204+° C.) distillation bottoms produced from steel industry coke ovens), heavy oil tar (the 900+° F. (482+° C.) bottoms produced by vacuum distillation of heavy oil), and the like.

Solvents preferably are rich in aromatics, sulfur, and nitrogen. Solvents can have a $S_{BN}$ of 50 to 200 and a $I_N$ of less than 10. Examples of solvents include, but are not limited to, 400° F. (204° C.) to 750° F. (399° C.) boiling point hydrocarbons, light cycle oils, extracts, naphthenic oils, and the like.

Further, the solvent preferably maintains the liquid phase in the hydrocracking reactor at a reasonably low viscosity. If too much 400° F. (204° C.) to 750° F. (399° C.) boiling point hydrocarbons are removed in the process, the liquid film thickness in the reactor will increase, and the catalyst will coke rapidly.

Regarding the reactor conditions used to maximize reaction medium solvency and minimize PNA production, the conditions are maintained to facilitate kinetic control over the reaction. That is, the diffusion of the reactive molecules is faster than the reaction, which speeds up the desired reactions. One such condition regulated is pressure. Higher pressure shifts the reaction equilibrium toward aromatic saturation, which lowers the concentration of PNA precursors and accelerates the hydrodenitrogenation reactions. The hydrodenitrogenation reactions prevent the formation of nitrogen-containing PNAs.

Additionally, the gas treat rate is preferably high in the reactor because the more gas in the reactor, the more light liquids are stripped from the liquid phase. Without being limited by theory, molecules below their critical temperatures dissolved in liquids have a disproportionate impact on the solvency of the liquid. For example, naphthalene has a critical temperature of 473° C. and propylbenzene has a critical temperature of 365° C. The instant invention operates preferably between 360° C. and 430° C. High levels of low molecular weight dissolved molecules dramatically reduce solubility. High gas treat rates keep molecules with critical temperatures below the reaction temperature largely in the gas phase in the reactor.

Further, a low liquid hourly space volume (LHSV) when operating the hydrocracking reactor minimizes the diffusion limitations and keep start of cycle temperature down.

Regarding the catalyst to maximize reaction medium solvency and minimize PNA production, the catalyst preferably has large pores to facilitate diffusion of the reactive molecules. Further, in some instances, a series of stacked catalyst beds are used to control the reaction progression as the feed passes through the reactor. For example, cracking reactions can be minimized until after the nitrogen and sulfur have been removed and the bulk of the aromatics are saturated by ordering the catalyst beds appropriately. This minimizes the concentration of PNA precursors exposed to the hydrocracking catalyst.

FIG. 1 is an illustrative diagram of an example process 100 of the present invention. A hydrocracking unit 101 includes a hydrocracking reactor and downstream separator. The hydrocracking reactor receives a PNA feed stream 102, optionally a solvent stream 103, and a hydrogen stream 104. Each stream may be introduced to the hydrocracking reactor separately, or two or more may be mixed before introduction to the hydrocracking reactor.

As used herein, when a compositional term modifies "stream," the stream comprises that composition. The compositional term does not indicate that the stream consists of only that composition. For example, a PNA feed stream is a stream that comprises PNA and does not necessarily consist only of PNA. Further, the compositional term does not indicate a certain minimum concentration of the composition in the stream. For example, a PNA feed stream can comprise 10 mol % PNA or less.

The hydrocracking reactor contains one or more catalysts that catalyze the cracking of the components in the PNA feed stream. The product is then transported to the separator (e.g., an atmospheric or vacuum distillation unit) where it is separated by boiling point into several product streams 105-109. The composition and relative concentration of each product stream 105-109 depends on the composition of the PNA feed stream 102, the catalysts used, and the distillation parameters. Examples of product streams 105-

109 include, but are not limited to, $C_{4-}$ paraffins, gasoline, ULSD, base stock oil, $H_2S$ gas, and the like.

The hydrocracking can convert 75 wt % or greater (e.g., 75 wt % to 100 wt %) of the 3-ring aromatics in the PNA feed stream to saturates, or alternatively 90 wt % or greater of the 3-ring aromatics in the PNA feed stream to saturates, or alternatively 95 wt % or greater of the 3-ring aromatics in the PNA feed stream to saturates.

Figure 2:
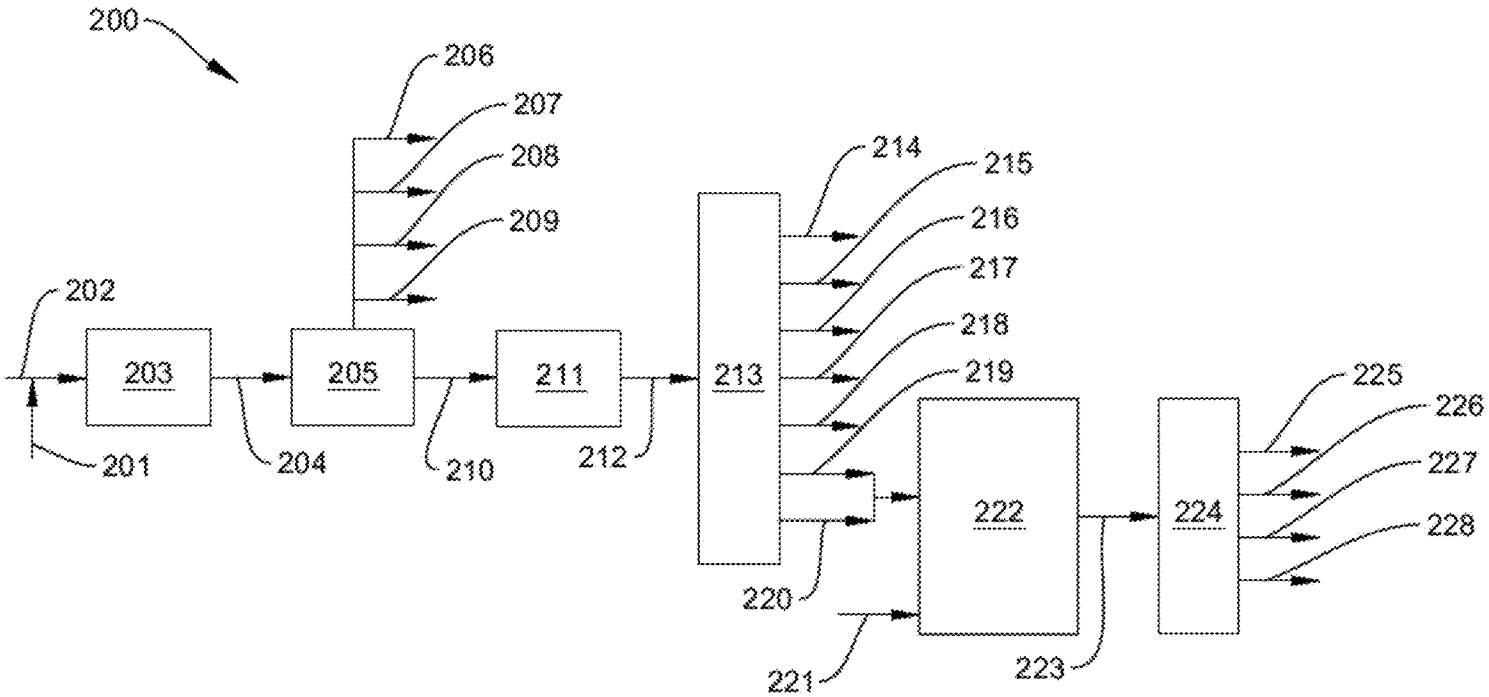
FIG. 2 is an illustrative diagram of an example process that incorporates the process of the present invention that upgrades streams with appreciable amounts of PNA.

FIG. 2 is an illustrative diagram of an example process 200 that incorporates the process of the present invention that upgrades streams with appreciable amounts of PNA. This example upgrades the vacuum residue from tar sand refining. A hydrogen stream 201 is entrained with a feed stream 202 comprising vacuum residue from tar sand refining, which is then fed into a hydroprocessing reactor 203 (e.g., a fixed bed hydroprocessing reactor). The product 204 is then transported to a separation unit 205 for separation (e.g., by distillation) into several product streams 206-210. Examples of such streams include, but are not limited to, an $H_2S$ gas stream 206, a $C_{4-}$ paraffins stream 207, a naphtha stream 208, a 350° F. (177° C.) to 700° F. (371° C.) boiling point stream 209 (or a distillate stream 209), and a 700+° F. (371+° C.) boiling point stream 210. The bottoms, which in this example is 700+° F. (371+° C.) boiling point stream 210, is transported to a fluid catalytic cracking (FCC) reactor 211. In the fluid catalytic cracking reactor, the components of stream 210 are converted to lower boiling hydrocarbons suitable for use as fuels. The resultant product 212 is then transported to a separation unit 213 for separation (e.g., by distillation) into several product streams 214-220. Examples of such streams include, but are not limited to, a $C_{4-}$ paraffins stream 214, an ethylene stream 215, a propylene stream 216, a butenes stream 217, a gasoline stream 218, a liquid cycle oil stream 219, and a main column bottoms stream 220.

In a traditional operation, the main column bottoms stream 220 is used for making high sulfur heavy aromatic fuel oil (HAFO). In contrast, the present invention uses the main column bottoms stream 220 as a PNA feed stream and the liquid cycle oil stream 219 as a solvent stream as feed for hydrocracking. The main column bottoms stream 220 and the liquid cycle oil stream 219 along with a hydrogen stream 221 are fed to a hydrocracking reactor 222. The hydrogen and liquid cycle oil act as solvents for the main column bottoms. Two or more of these three streams 219, 220, 221 can be mixed before entry into the hydrocracking reactor 222. Alternatively, each stream 219, 220, 221 can enter the hydrocracking reactor 222 separately. The hydrocracking process produces a product stream 223 that is separated in separation unit 224. In this example, the separation unit 224 produces a $H_2S$ stream 225, a LPG stream 226, a gasoline stream 227, and a ULSD stream 228. The separation unit 224 can be designed for other product streams.

Figure 3:
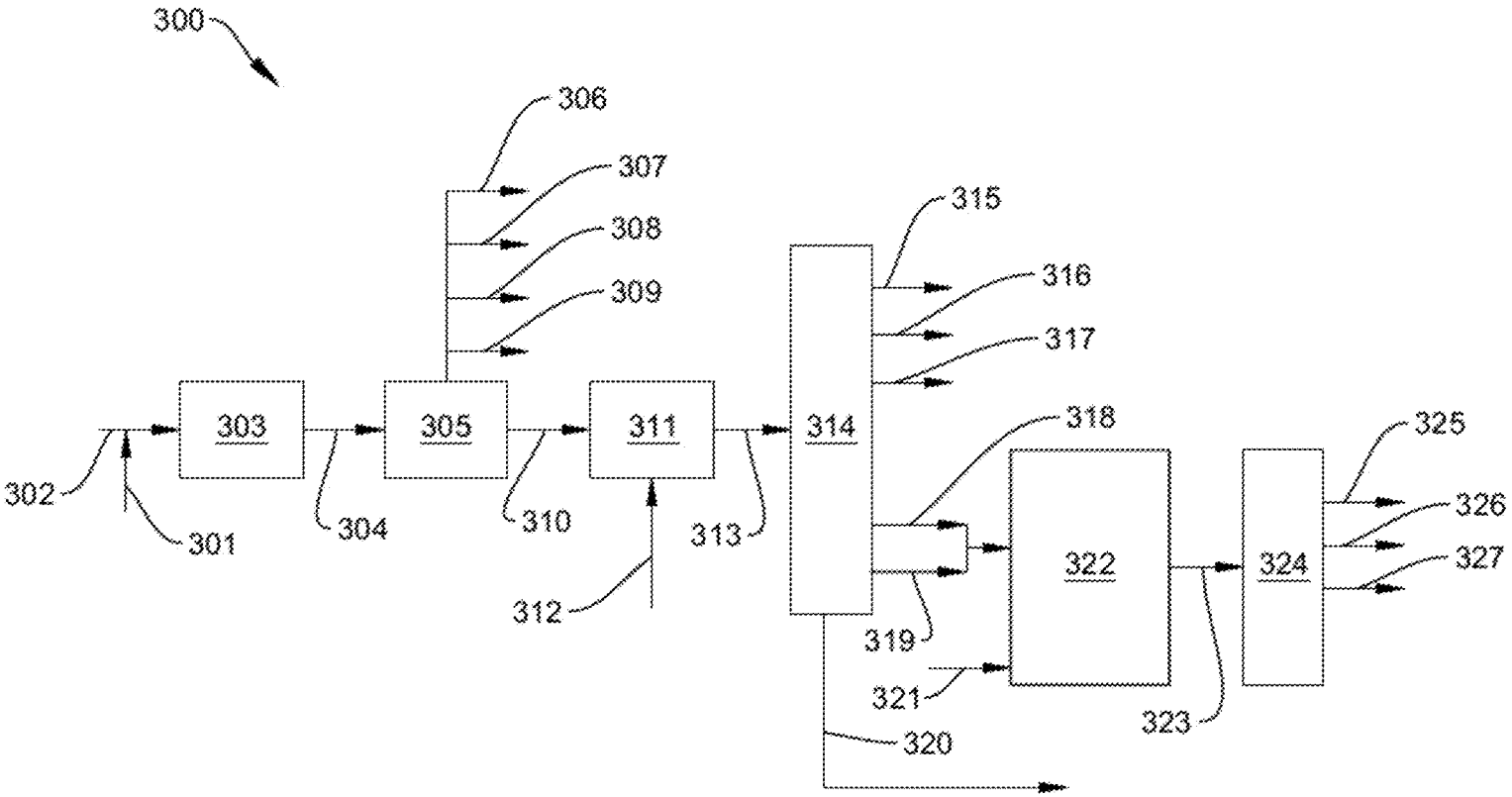
FIG. 3 is an illustrative diagram of an example process that incorporates the process of the present invention that upgrades streams with appreciable amounts of PNA.

FIG. 3 is an illustrative diagram of another example process 300 that incorporates the process of the present invention that upgrades streams with appreciable amounts of PNA. This example upgrades the vacuum residue (feed) from tar sand refining. A hydrogen stream 301 is entrained with a feed stream 302 comprising vacuum residue from tar sand refining, which is then fed into a slurry hydrocracking reactor 303. The product 304 is then transported to a separation unit 305 for separation (e.g., by distillation) into several product streams 306-310. Examples of such streams include, but are not limited to, an $H_2S$ gas stream 306, a $C_{4-}$ paraffins stream 307, a naphtha stream 308, a 350° F. (177° C.) to 700° F. (371° C.) boiling point stream 309, and a 700+° F. (371+° C.) boiling point stream 310. The bottoms, which in this example is 700+° F. (371+° C.) boiling point stream 310, is transported to a solvent assisted hydroprocessing reactor 311. A hydrogen stream 312 is also fed into the solvent assisted hydroprocessing reactor 311. In the solvent assisted hydroprocessing reactor 311, the components of stream 310 and hydrogen stream 312 are converted to lower boiling hydrocarbons suitable for use as fuels. The resultant product 313 is then transported to a separation unit 314 for separation (e.g., by distillation) into several product streams 315-320. Examples of such streams include, but are not limited to, a $H_2S$ stream 315, a $C_{4-}$ paraffins stream 316, a gasoline stream 317, a 400° F. (204° C.) to 700° F. (371° C.) boiling point stream 318, a 700° F. (371° C.) to 950° F. (510° C.) boiling point stream 319, and a 950° F.+(510+° C.) boiling point stream 320.

In a traditional operation, the 700° F. (371° C.) to 950° F. (510° C.) boiling point stream 319 is used for making HAFO. In contrast, the present invention uses the 700° F. (371° C.) to 950° F. (510° C.) boiling point stream 319 as a PNA feed stream and the 400° F. (204° C.) to 700° F. (371° C.) boiling point stream 318 as a solvent stream as feed for hydrocracking. The 700° F. (371° C.) to 950° F. (510° C.) boiling point stream 319 and the 400° F. (204° C.) to 700° F. (371° C.) boiling point stream 318 along with a hydrogen stream 321 are fed to a hydrocracking reactor 322. The hydrogen and 400° F. (204° C.) to 700° F. (371° C.) boiling point product act as solvents for the 700° F. (371° C.) to 950° F. (510° C.) boiling point product. Two or more of these three streams 318, 319, 321 can be mixed before entry into the hydrocracking reactor 322. Alternatively, each stream 318, 319, 321 can enter the hydrocracking reactor 322 separately. The hydrocracking process produces a product stream 323 that is separated in separation unit 324. In this example, the separation unit 324 produces a LPG stream 325, a gasoline stream 326, and a ULSD stream 327. The separation unit 324 can be designed for other product streams.

Figure 4:
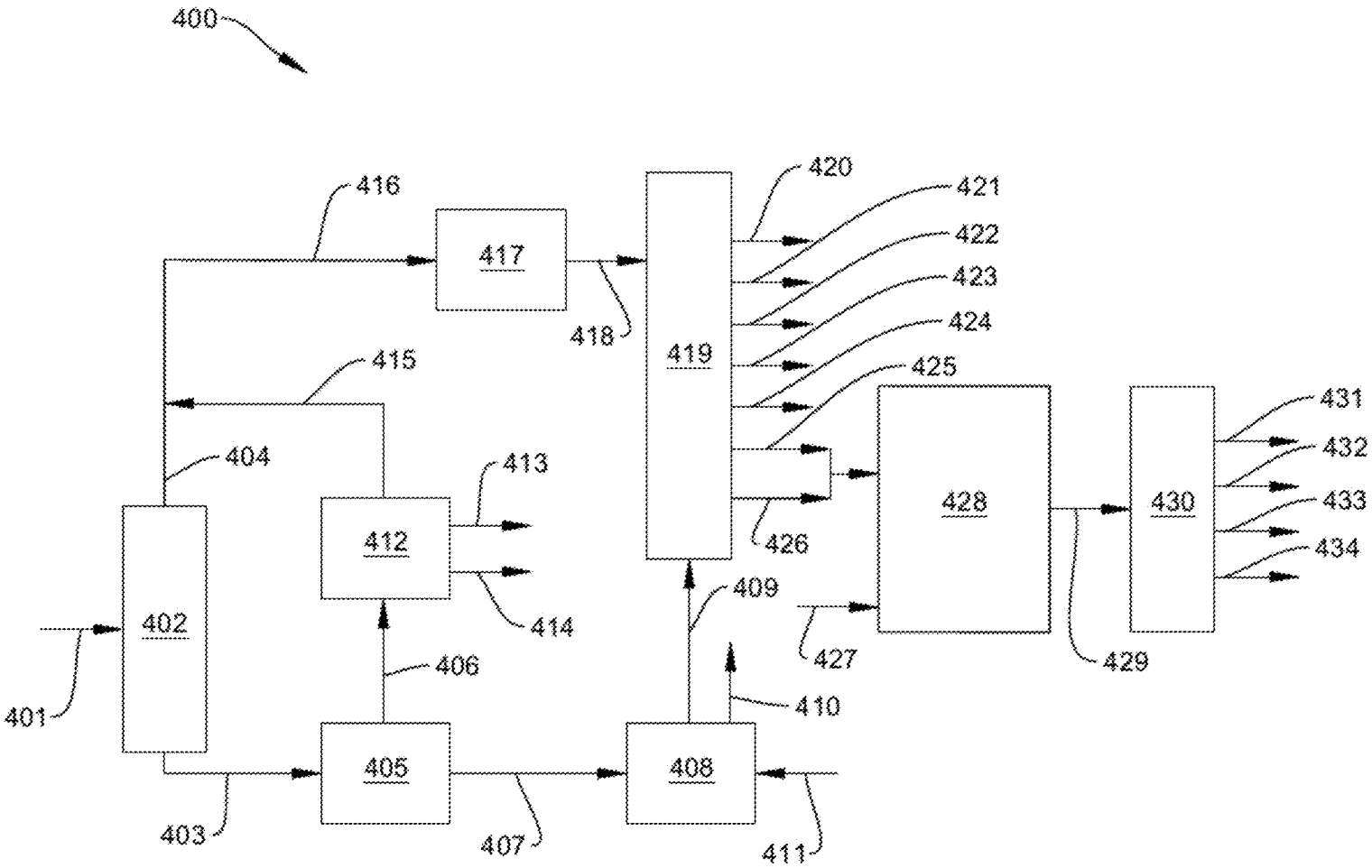
FIG. 4 is an illustrative diagram of an example process that incorporates the process of the present invention that upgrades streams with appreciable amounts of PNA.

FIG. 4 is an illustrative diagram of yet another example process 400 that incorporates the process of the present invention that upgrades streams with appreciable amounts of PNA. Feed stream 401 is distilled in separator 402 to produce a vacuum residue 403 stream and a vacuum gas oil stream 404. The vacuum residue 403 stream is deasphalted in a deasphalting unit 405 to produce deasphalted oil 406 and rock 407. The rock 407 is treated by slurry hydrocracking in hydrocracker 408 in the presence of hydrogen 411 to produce a product stream 409 and an $H_2S$ stream 410. The product stream 409 from the hydrocracker 408 is fed to the separator 419. The deasphalted oil 406 is hydroprocessed in a hydroprocessing unit 412 (e.g., a fixed bed hydroprocessing unit) to produce a $H_2S$ stream 413, a $C_{15-}$ paraffin stream 414, and a 450+° F. (232+° C.) stream 415. The 450+° F. (232+° C.) stream 415 is entrained with the vacuum gas oil stream 404 to produce a mixed stream 416 that is fed to the fluid catalytic cracking (FCC) unit 417. The products of the FCC unit 417 are fed to the separator 419. The product stream 409 from the hydrocracker 408 and the mixed stream 416 are separated (e.g., via distillation) in the separator 419 to produce a plurality of product streams 420-426. Examples of such streams include, but are not limited to, a $C_{4-}$ paraffins stream 420, an ethylene stream 421, a propylene stream 422, a butenes stream 423, a gasoline stream 424, a liquid cycle oil stream 425, and a main column bottoms stream 426.

In a traditional operation, the main column bottoms stream 426 is used for making heavy aromatic fuel oil (HAFO). In contrast, the present invention uses the main column bottoms stream 426 as a PNA feed stream and the liquid cycle oil stream 425 as a solvent stream as feed for hydrocracking. The main column bottoms stream 426 and the liquid cycle oil stream 425 along with a hydrogen stream 427 are fed to a hydrocracking reactor 428. The hydrogen and liquid cycle oil act as solvents for the main column bottoms. Two or more of these three streams 425, 426, 427 can be mixed before entry into the hydrocracking reactor 428. Alternatively, each stream 425, 426, 427 can enter the hydrocracking reactor 428 separately. The hydrocracking process produces a product stream 429 that is separated in separation unit 430. In this example, the separation unit 430 produces a $H_2S$ stream 431, a LPG stream 432, a gasoline stream 433, and a ULSD stream 434. The separation unit 430 can be designed for other product streams.

Figure 5:
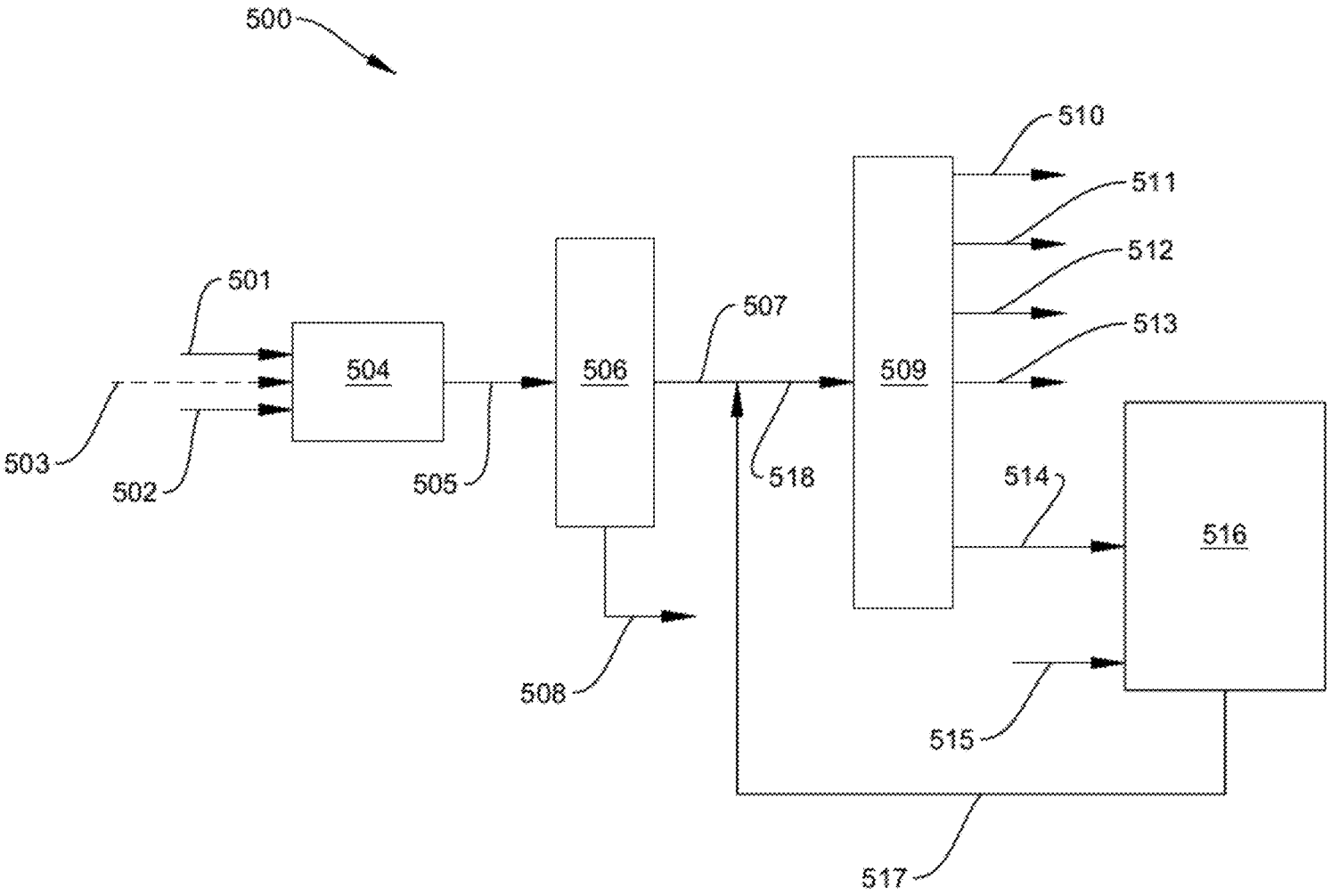
FIG. 5 is an illustrative diagram of an example process that incorporates the process of the present invention that upgrades streams with appreciable amounts of PNA.

FIG. 5 is an illustrative diagram of another example process 500 that incorporates the process of the present invention that upgrades streams with appreciable amounts of PNA. In this example, the process of the present invention is used twice: first for upgrading an as-produced high PNA feed and second for recycle upgrading of the first upgraded product. A hydrogen stream 501, main column bottoms stream 502 (high PNA stream), and optionally a solvent stream 503 are fed to a hydroprocessing reactor 504 for the first upgrading process of the present invention. The product stream 505 from the hydrocracking reactor 504 is vacuum flash separated in separator 506 to produce an overheads stream 507 and a 950+° F. (510° C.) bottoms stream 508. The 950+° F. (510+° C.) bottoms stream 508 is considered the only non-upgraded product of the process. The overheads stream 507 is mixed with a recycle stream 517 (described below) to produce mixed stream 518, which is distilled in separator 509 to produce several upgraded product streams 510-514. Examples of these streams include, but are not limited to, a $H_2S$ stream 510, a $C_{4-}$ paraffin stream 511, a gasoline stream 512, a ULSD stream 513, and a 700° F. (371° C.) to 950° F. (510° C.) stream 514. The 700° F. (371° C.) to 950° F. (510° C.) stream 514 and hydrogen stream 515 are fed to a second hydrocracking reactor 516 for upgrading by the processes of the present invention. The product from the hydrocracking reactor 516 is the recycle stream 517 that is mixed with the overheads stream 507 from the separator 506 for distillation in separator 509.

In the example illustrated in FIG. 5, the hydrocracking reactor 504 can have a catalyst that is more robust and less susceptible to fouling because the main column bottoms stream 502 can have high concentrations of sulfur (e.g., greater than 2 wt % sulfur) and nitrogen. The separator 509 removes the sulfur and nitrogen from the mixed stream 518, so that the 700° F. (371° C.) to 950° F. (510° C.) stream 514 has less than 100 ppm of sulfur and less than 100 ppm nitrogen. Accordingly, a base metal catalyst may be suitable for use in the first hydrocracking reactor 504; and a more active catalyst like a NiMo sulfided catalyst and/or a noble metal catalyst may be suitable for use in the second hydrocracking reactor 516. Examples of base metal catalysts include, but are not limited to, a zeolitic base selected from zeolite Beta, zeolite X, zeolite Y, faujasite, ultrastable Y (USY), dealuminized Y (Deal Y), Mordenite, ZSM-3, ZSM-4, ZSM-18, ZSM-20, ZSM-48, and combinations thereof, which base can advantageously be loaded with one or more Group VIB and Group VIII non-noble metals. Commercially available base metal catalyst include the NEBULA® catalysts (available from Albemarle Catalysts Company LP). Examples of noble metal catalysts include, but are not limited to, noble metal and noble metal complexes of ruthenium, rhodium, platinum, palladium, and the like on supports like amorphous supports, mesoporous supports, and zeolites. Specific examples of noble metal catalysts and methods of making such catalysts can be found in U.S. Pat. Nos. 5,098,684; 7,745,373; and 9,861,960, which are incorporated herein by reference.

When multiple catalysts are used in the second hydrocracking reactor 516, one or more base metal catalyst may be used in the second hydrocracking reactor 516 upstream of the more active catalyst. In this example, by using two types of catalyst and recycling product for further upgrading, up to 95 wt % (e.g., 50 wt % to 95 wt %, or alternatively 75 wt % to 95 wt %) of the original PNA feed can be upgraded to products like LPG, gasoline, and ULSD. When successive hydrocracking is performed (e.g., FIG. 5), the successive hydrocracking processes can convert 90 wt % or greater (e.g., 90 wt % to 100 wt %) of the 3-ring aromatics in the PNA feed stream to saturates, or alternatively 90 wt % or greater of the 3-ring aromatics in the PNA feed stream to saturates, or alternatively 95 wt % or greater of the 3-ring aromatics in the PNA feed stream to saturates.

The hydrocracking reactor according to the processes of the present invention (e.g., as described in FIGS. 1-5) can operate at 380° C. to 430° C., alternatively 380° C. to 400° C., or alternatively 400° C. to 430° C.

The hydrocracking reactor according to the processes of the present invention can operate at 2500 psig or greater, alternatively 3000 psig or greater, or alternatively 3250 psig or greater.

The hydrocracking reactor according to the processes of the present invention can operate at 0.1 $hr^{-1}$ to 5 $hr^{-1}$ LSHV, alternatively 0.1 $hr^{-1}$ to 2 $hr^{-1}$ LSHV, or alternatively 0.5 $hr^{-1}$ to 3 $hr^{1}$ LSHV.

The hydrocracking reactor according to the processes of the present invention can operate at 380° C. to 430° C., 2500 psig or greater, and 0.1 $hr^{-1}$ to 5 $hr^{-1}$ LSHV. One skilled in the art will recognize that reactor design and materials should be modified for safe operation under such conditions.

When a solvent is used, the weight ratio of PNA feed stream to solvent according to the processes of the present invention can be 1:2 to 10:1, alternatively 1:1 to 8:1, or alternatively 4:1 to 10:1.

The weight ratio of PNA feed stream to hydrogen according to the processes of the present invention can be 10:1 to 30:1, alternatively 15:1 to 30:1, or alternatively 10:1 to 20:1.

The PNA feed stream and product stream from the hydrocracking reactor according to the processes of the present invention can be characterized in different ways regarding their composition.

The PNA feed stream can have 25 wt % or less of hydrocarbons having a boiling point of 700° F. (371° C.) or less and having an aromatic content of 50 wt % or greater, alternatively 20 wt % or less of hydrocarbons having a boiling point of 700° F. (371° C.) or less and having an aromatic content of 60 wt % or greater, or alternatively 15 wt % or less of hydrocarbons having a boiling point of 700° F. (371° C.) or less and having an aromatic content of 70 wt % or greater, while the product stream from the hydrocracking reactor can comprises 50 wt % or greater of the hydrocarbons having a boiling point of 700° F. (371° C.) or less and having an aromatic content of 20 wt % or less, alternatively 60 wt % or greater of the hydrocarbons having a boiling point of 700° F. (371° C.) or less and having an aromatic content of 15 wt % or less, or alternatively 70 wt % or greater of the hydrocarbons having a boiling point of 700° F. (371° C.) or less and having an aromatic content of 10 wt % or less.

The PNA feed stream can comprise 15 mol % or less of saturates, and the product comprises 65 mol % or greater of saturates. Alternatively, the PNA feed stream can comprise 12 mol % or less of saturates, and the product comprises 70 mol % or greater of saturates. Alternatively, the PNA feed stream can comprise 10 mol % or less of saturates, and the product comprises 75 mol % or greater of saturates.

The PNA feed stream can comprise 10 mol % or less of PNA 900+° F. (482+° C.) vacuum residue pitch, alternatively 15 mol % or less of PNA 900+° F. (482+° C.) vacuum residue pitch, or alternatively 20 mol % or less of PNA 900+° F. (482+° C.) vacuum residue pitch.

The distilled product streams except any $H_2S$ stream can have a sulfur content of 15 ppm or less, or alternatively 10 ppm or less, or alternatively 5 ppm or less.

The product stream from the hydrocracking reactor and/or the streams after distillation of the product stream from the hydrocracking reactor can optionally be further refined, for example, by hydrotreating, by the Arosat process, and/or further hydrocracking according to the processes of the present invention.

The catalyst bed in the hydrocracking reactor according to the processes of the present invention can include one or more hydroprocessing catalysts. Suitable hydroprocessing catalysts include those comprising (i) one or more bulk metals and/or (ii) one or more metals on a support. The metals can be in elemental form or in the form of a compound. In one or more embodiments, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

The catalyst can have a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

The catalyst can comprise at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example, the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

The catalyst can include at least one Group 6 metal and further include at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10 (e.g., molybdenum-cobalt and/or tungsten-nickel), these metals can be present at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts that further comprise inorganic oxides, e.g., as a binder and/or support, are within the scope of the invention. For example, the catalyst can comprise (i)≥1.0 wt % of one or more metals selected from Groups 6, 8, 9, and 10 of the Periodic Table and (ii)≥1.0 wt % of an inorganic oxide, the weight percents being based on the weight of the catalyst.

The catalyst is a bulk multimetallic hydroprocessing catalyst with or without binder. For example, the catalyst can be a bulk trimetallic catalyst comprised of two Group 8 metals, preferably Ni and Co and the one Group 6 metals, preferably Mo.

The catalytic metals can be incorporated into (or deposited on) a support to form the hydroprocessing catalyst. The support can be a porous material. For example, the support can comprise one or more refractory oxides, porous carbon-based materials, zeolites, or combinations thereof suitable refractory oxides include, for example, alumina, silica, silica-alumina, titanium oxide, zirconium oxide, magnesium oxide, and mixtures thereof. Suitable porous carbon-based materials include, but are not limited to, activated carbon and/or porous graphite. Examples of zeolites include, but are not limited to, Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina (e.g., theta alumina) in an amount in the range of from 0.1 grams to 0.99 grams, or from 0.5 grams to 0.9 grams, or from 0.6 grams to 0.8 grams, the amounts being per gram of the support. The amount of alumina can be determined using, for example, x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain embodiments, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature≥400° C. to form the hydroprocessing catalyst. Typically, such heat treating is conducted at temperatures≤1200° C.

The catalyst can be in shaped forms (e.g., one or more of discs, pellets, extrudates, etc.) though this is not required. Non-limiting examples of such shaped forms include those having a cylindrical symmetry with a diameter in the range of from about 0.79 mm to about 3.2 mm (1/32nd to 1/8th inch), from about 1.3 mm to about 2.5 mm (1/20th to 1/10th inch), or from about 1.3 mm to about 1.6 mm (1/20th to 1/16th inch). Similarly-sized non-cylindrical shapes like trilobe and quadralobe are within the scope of the invention. Optionally, the catalyst has a flat plate crush strength in a range of from 50-500 N/cm, or 60-400 N/cm, or 100-350 N/cm, or 200-300 N/cm, or 220-280 N/cm.

Porous catalysts, including those having conventional pore characteristics, are within the scope of the invention. When a porous catalyst is utilized, the catalyst can have a pore structure, pore size, pore volume, pore shape, pore surface area, etc., in ranges that are characteristic of conventional hydroprocessing catalysts, though the invention is not limited thereto. For example, the catalyst can have a median pore size that is effective for hydroprocessing SCT molecules, such catalysts having a median pore size in the range of from 30 Å to 1000 Å, or 50 Å to 500 Å, or 60 Å to 300 Å. Pore size can be determined according to ASTM D4284-07 Mercury Porosimetry.

In a particular embodiment, the hydroprocessing catalyst has a median pore diameter in a range of from 50 Å to 200 Å. Alternatively, the hydroprocessing catalyst has a median pore diameter in a range of from 90 Å to 180 Å, or 100 Å to 140 Å, or 110 Å to 130 Å. In another embodiment, the hydroprocessing catalyst has a median pore diameter ranging from 50 Å to 150 Å. Alternatively, the hydroprocessing catalyst has a median pore diameter in a range of from 60 Å to 135 Å, or from 70 Å to 120 Å. In yet another alternative, hydroprocessing catalysts having a larger median pore diameter are utilized, e.g., those having a median pore diameter in a range of from 180 Å to 500 Å, or 200 Å to 300 Å, or 230 Å to 250 Å.

Generally, the hydroprocessing catalyst has a pore size distribution that is not so great as to significantly degrade catalyst activity or selectivity. For example, the hydroprocessing catalyst can have a pore size distribution in which at least 60% of the pores have a pore diameter within 45 Å, 35 Å, or 25 Å of the median pore diameter. In certain embodiments, the catalyst has a median pore diameter in a range of from 50 Å to 180 Å, or from 60 Å to 150 Å, with at least 60% of the pores having a pore diameter within 45 Å, 35 Å, or 25 Å of the median pore diameter.

When a porous catalyst is utilized, the catalyst can have a pore volume≥0.3 $cm^3/g$, such ≥0.7 $cm^3/g$, or ≥0.9 $cm^3/g$. In certain embodiments, pore volume can range from 0.3 $cm^3/g$ to 0.99 $cm^3/g$, 0.4 $cm^3/g$ to 0.8 $cm^3/g$, or 0.5 $cm^3/g$ to 0.7 $cm^3/g$.

In certain embodiments, a relatively large surface area can be desirable. As an example, the hydroprocessing catalyst can have a surface area≥60 $m^2/g$, or ≥100 $m^2/g$, or ≥120 $m^2/g$, or ≥170 $m^2/g$, or ≥220 $m^2/g$, or ≥270 $m^2/g$; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain embodiments, the catalysts include one or more of KF860 available from Albemarle Catalysts Company LP; NEBULA® Catalyst, such as NEBULA® 20, available from the same source; CENTERA® catalyst, available from Criterion Catalysts and Technologies, such as one or more of DC-2618, DN-2630, DC-2635, and DN-3636; ASCENT® Catalyst, available from the same source, such as one or more of DC-2532, DC-2534, and DN-3531; and FCC pre-treat catalyst, such as DN3651 and/or DN3551, available from the same source. However, the invention is not limited to only these catalysts.

When hydrocracking methods of the present invention are utilized in sequence, preferably the first hydrocracking reactor uses a base metal catalyst that can tolerate higher concentrations of nitrogen and sulfur. The second hydrocracking reactor can use a noble metal catalyst. Examples of noble metal catalysts include, but are not limited to, a zeolitic base selected from zeolite Beta, zeolite X, zeolite Y, faujasite, ultrastable Y (USY), dealuminized Y (Deal Y), Mordenite, ZSM-3, ZSM-4, ZSM-18, ZSM-20, ZSM-48, and combinations thereof, which base can advantageously be loaded with one or more Group VIII noble metals such as platinum and/or palladium.

When more than one catalyst is used in a single hydrocracking reactor, the catalysts can be blended and/or stacked. In a stacked configuration, the PNA feed stream is exposed to the catalysts sequentially.

EXAMPLE EMBODIMENTS

A first example embodiment is a method comprising: hydrocracking a polynucleararomatic hydrocarbon (PNA) feed in the presence of a catalyst and hydrogen at 380° C. to 430° C., 2500 psig or greater, and 0.1 $hr^{-1}$ to 5 $hr^{-1}$ liquid hourly space velocity (LSHV), wherein the weight ratio of PNA feed to hydrogen is 30:1 to 10:1, wherein the PNA feed comprises 25 wt % or less of hydrocarbons having a boiling point of 700° F. (371° C.) or less and having an aromatic content of 50 wt % or greater to form a product comprising 50 wt % or greater of the hydrocarbons having a boiling point of 700° F. (371° C.) or less and having an aromatic content of 20 wt % or less. The method can optionally further include one or more of the following: Element 1: the method further comprising: distilling the product to produce one or more fractions selected from the group consisting of: a C4− paraffin stream comprising less than 15 ppm sulfur, a naphtha fraction having less than 15 ppm sulfur, a distillate fraction having less than 15 ppm sulfur, and a 700+° F. (371+° C.) boiling point stream having less than 15 ppm sulfur; Element 2: wherein the PNA feed comprises 2 wt % or greater sulfur; Element 3: wherein the aromatic content of the PNA feed is 70 wt % or greater and the aromatic content of product is 10 wt % or less; Element 4: wherein the PNA feed is selected from the group consisting of steam cracker tar, FCC main column bottoms (MCB) (the 650+° F. (343+° C.) distillation bottoms produced from refinery fluid catalytic crackers), coal tar (the 400+° F. (204+° C.) distillation bottoms produced from steel industry coke ovens), and heavy oil tar (the 900+° F. (482+° C.) bottoms produced by vacuum distillation of heavy oil); Element 5: wherein the PNA feed has a $S_{BN}$ of greater than 135 and an $I_N$ of greater than 100; Element 6: wherein the hydrocracking of the PNA feed is in the presence of the catalyst, the hydrogen, and a solvent; Element 7: Element 6 and wherein the solvent has a $S_{BN}$ of 50 to 200 and an $I_N$ less than 10; Element 8: Element 6 and wherein the solvent is selected from the group consisting of 400° F. (204° C.) to 750° F. (399° C.) boiling point hydrocarbons, light cycle oils, and a combination thereof; Element 9: wherein the hydrocracking converts 75 wt % or greater of 3-ring aromatics in the PNA feed to saturates; and Element 10: wherein the hydrocracking converts 90 wt % or greater of 3-ring aromatics in the PNA feed to saturates. Examples of combinations include, but are not limited to, Element 1 in combination with one or more of Elements 2-5 and optionally in further combination with one of Elements 9-10; Element 1 in combination with one or more of Elements 6-8 and optionally in further combination with one of Elements 9-10; Element 1 in combination with one of Elements 9-10; Element 1 in combination with one or more of Elements 2-5 and one or more of Elements 6-8; one or more of Elements 2-5 in combination with one or more of Elements 6-8 and optionally in further combination with one of Elements 9-10; and one of Elements 9-10 in combination with one or more of Elements 1-8.

Another method of the present invention is a method comprising: hydrocracking a polynucleararomatic hydrocarbon (PNA) feed in the presence of hydrogen and a base metal catalyst at 380° C. to 430° C., 2500 psig or greater, and 0.1 $hr^{-1}$ to 5 $hr^{-1}$ liquid hourly space velocity (LSHV), wherein the weight ratio of PNA feed to hydrogen is 30:1 to 10:1, wherein the PNA feed comprises 25 wt % or less of hydrocarbons having a boiling point of 700° F. (371° C.) or less and 2 wt % or greater sulfur and having an aromatic content of 50 wt % or greater to form a first product; separating the first product into an overheads stream and a 950+° F. (510+° C.) bottoms stream, wherein the overheads stream comprises 50 wt % or greater of the hydrocarbons having a boiling point of 700° F. (371° C.) or less and having an aromatic content of 20 wt % or less; distilling the overheads stream into a 700+° F. (371+° C.) boiling point stream having less than 15 ppm sulfur and one or more fractions selected from the group consisting of: a C4–paraffin stream comprising less than 15 ppm sulfur, a naphtha fraction having less than 15 ppm sulfur, and a distillate fraction having less than 15 ppm sulfur; and hydrocracking the 700+° F. (371+° C.) boiling point stream in the presence of hydrogen and a noble metal catalyst to form a second product. The method can optionally further include one or more of the following: Element 3; Element 4; Element 5; Element 9; Element 10; Element 11: the method further comprising: recycling the second product to mix the second product and the overheads before distillation; Element 12: wherein the hydrocracking of the PNA feed is in the presence of the base metal catalyst, the hydrogen, and a solvent; Element 13: Element 12 and wherein the solvent has a $S_{BN}$ of 50 to 200 and an $I_N$ less than 10; Element 14: Element 12 and wherein the solvent is selected from the group consisting of 400° F. (204° C.) to 750° F. (399° C.) boiling point hydrocarbons, light cycle oils, and a combination thereof; and Element 15: wherein hydrocracking the 700+° F. (371+° C.) boiling point stream includes passing the 700+° F. (371+° C.) boiling point stream and hydrogen over a base metal catalyst and then over the noble metal catalyst. Examples of combinations include, but are not limited to, Element 11 in combination with one or more of Elements 3-5 and optionally in further combination with one of Elements 9-10; Element 11 in combination with one of Elements 9-10; Element 11 in combination with one or more of Elements 12-14 and optionally in further combination with one of Elements 9-10; two or more of Elements 3-5 in combination and optionally in further combination with one of Elements 9-10; two or more of Elements 12-14 in combination and optionally in further combination with one of Elements 9-10; one or more of Elements 3-5 in combination with one or more of Elements 12-14 and optionally in further combination with one of Elements 9-10; and Element 15 in combination with one or more of Elements 3-5 and 9-14.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

To facilitate a better understanding of the embodiments of the present invention, the following examples of preferred or representative embodiments are given. In no way should the following examples be read to limit, or to define, the scope of the invention.

EXAMPLES

Example 1

A simulation was run using the process 200 illustrated in FIG. 2 with Cold Lake vacuum residue as the vacuum residue starting material. Table 1 includes the amount compositions of the various streams where reference numbers refer to FIG. 2.

TABLE 1

| Stream | Barrels | Composition |
|---|---|---|
| hydrogen stream 201 | 1.5 | |
| feed stream 202 | 100 | 10.5 wt % H<br>5 wt % S<br>20 MCR |
| $H_2S$ gas stream 206 | 4.5 | |
| $C_{4-}$ paraffins stream 207 | 1 | |
| naphtha stream 208 | 2 | |
| 350° F. (177° C.) to 700° F. (371° C.) boiling point stream 209 | 4 | |
| 700+° F. (371+° C.) boiling point stream 210 | 91 | 11.8 wt % H<br>0.6 wt % S<br>3 MCR |
| $C_{4-}$ paraffins stream 214 | 4.1 | |
| ethylene stream 215 | 0.8 | |
| propylene stream 216 | 9.3 | |
| butenes stream 217 | 9.8 | |
| gasoline stream 218 | 29.7 | |
| liquid cycle oil stream 219 | 16.8 | |
| main column bottoms stream 220 | 14.6 | |
| hydrogen stream 221 | 2.0 | |
| $H_2S$ stream 225 | 0.7 | |
| LPG stream 226 | 1 | |
| gasoline stream 227 | 7 | |
| ULSD stream 228 | 24.7 | |

Example 2

A simulation was run using the process 300 illustrated in FIG. 3 with Cold Lake vacuum residue as the vacuum residue starting material. Table 2 includes the amount compositions of the various streams where reference numbers refer to FIG. 3.

TABLE 2

| Stream | Barrels | Composition |
|---|---|---|
| hydrogen stream 301 | 1.0 | |
| feed stream 302 | 100 | 10.3 wt % H<br>5 wt % S<br>20 MCR |
| $H_2S$ gas stream 306 | 4 | |
| $C_{4-}$ paraffins stream 307 | 8 | |
| naphtha stream 308 | 22 | |
| 350° F. (177° C.) to 700° F. (371° C.) boiling point stream 309 | 26 | |
| 700+° F. (371+° C.) boiling point stream 310 | 40 | 7.5 wt % H<br>3.0 wt % S<br>12 MCR |
| hydrogen stream 312 | 1.0 | |
| $H_2S$ stream 315 | 1.2 | |
| $C_{4-}$ paraffins stream 316 | 0.5 | |
| gasoline stream 317 | 1 | |
| 400° F. (204° C.) to 700° F. (371° C.) boiling point stream 318 | 7 | |
| 700° F. (371° C.) to 950° F. (510° C.) boiling point stream 319 | 27 | |
| 950+° F. (510+° C.) boiling point stream 320 | 4 | |
| hydrogen stream 321 | 2.5 | |
| LPG stream 325 | 1 | |
| gasoline stream 326 | 9 | |
| ULSD stream 327 | 31.5 | |

Example 3

A simulation was run using the process 400 illustrated in FIG. 4 with Cold Lake vacuum residue as the vacuum residue starting material. Table 3 includes the amount compositions of the various streams where reference numbers refer to FIG. 4.

TABLE 3

| Stream | Barrels | Composition |
|---|---|---|
| feed stream 401 | 100 | 10.5 wt % H<br>5 wt % S<br>20 MCR |
| vacuum residue 403 stream | 50 | |
| vacuum gas oil stream 404 | 50 | 11.7 wt % H<br>2.8 wt % S |
| deasphalted oil stream 406 | 30 | 10.5 wt % H<br>4.7 wt % S<br>15 MCR |
| rock stream 407 | 20 | 7 wt % S<br>45 wt % MCR |
| product stream 409 | 19.7 | |
| $H_2S$ gas stream 410 | 1.1 | |
| hydrogen stream 411 | 0.8 | |
| $H_2S$ stream 413 | 1.2 | |
| $C_{15-}$ paraffin stream 414 | 1.8 | |
| 450+° F. (232+° C.) stream 415 | 27 | 12.0 wt % H<br>1 wt % S<br>3 wt % MCR |
| mixed stream 416 | 77 | 11.8 wt % H<br>0.6 wt % S<br>3 wt % MCR |
| $C_{4-}$ paraffins stream 420 | 4.1 | |
| ethylene stream 421 | 0.8 | |
| propylene stream 422 | 9.3 | |
| butenes stream 423 | 9.8 | |
| gasoline stream 424 | 29.7 | |
| liquid cycle oil stream 425 | 19.8 | |
| main column bottoms stream 426 | 17.6 | |
| hydrogen stream 427 | 2.0 | |
| $H_2S$ stream 431 | 0.7 | |
| LPG stream 432 | 1 | |
| gasoline stream 433 | 11 | |
| ULSD stream 434 | 27.7 | |

Example 4

A main columns bottom (MCB) was produced and run using the process 500 illustrated in FIG. 5 without solvent. The MCB had the following properties: 1.16 g/cc density; 2.83 wt % sulfur; 0.19 wt % nitrogen; 12 wt % MCR; 3.4 wt % n-heptane insolubles; 7.56 wt % hydrogen; 67 cSt viscosity at 80° C.; 20 cSt viscosity at 105° C.; and simulated distillation values for T10 of 680° F. (360° C.), T50 of 784° F. (418° C.), T90 of 973° F. (522° C.), and 7 wt % 1050+° F. (566+° C.).

Figure 6:
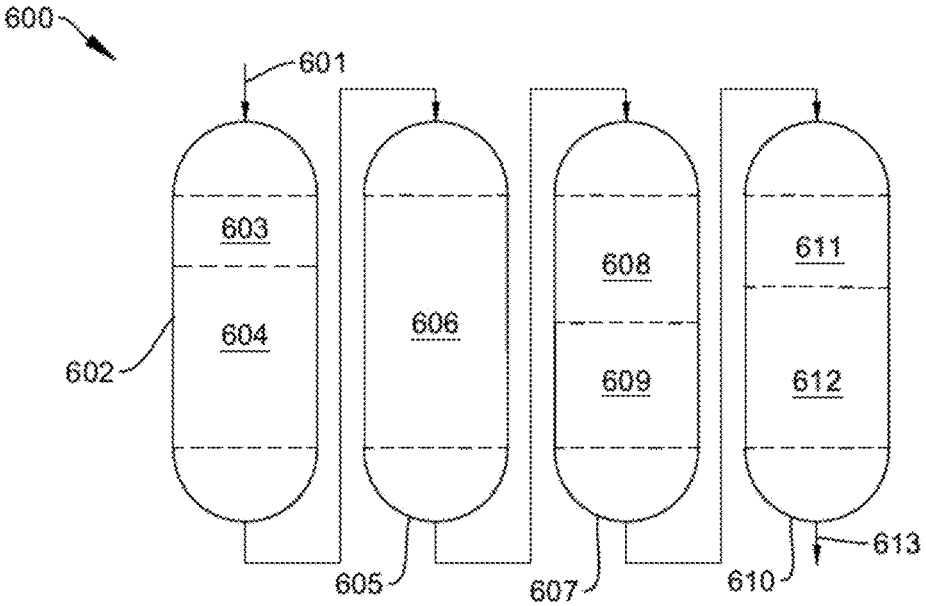
FIG. 6 illustrates the catalyst bed design of the first hydrocracking reactor.

FIG. 6 illustrates the catalyst bed design 600 of the first hydrocracking reactor 504. The reactants (hydrogen and MCB) are fed into a first catalyst bed 602 via stream 601. The first catalyst bed 602 includes 30 $cm^3$ of a low activity, large pore sulfide NiMo on alumina catalyst stacked on 140 $cm^3$ of medium pore sulfided NiMo on alumina hydrotreating catalyst bed 604. The material then passes to a second catalyst bed 605 containing 170 $cm^3$ of medium pore sulfided NiMo on alumina hydrotreating catalyst 606. The material then passes to a third catalyst bed 607 containing 73 $cm^3$ of medium pore sulfided NiMo on alumina hydrotreating catalyst 606 stacked on 70 $cm^3$ of sulfide noble metal hydrotreating catalyst 609. The material then passes to a fourth catalyst bed 610 containing 38 $cm^3$ of sulfided noble metal hydrotreating catalyst 611 stacked on 84 $cm^3$ of a sulfided NiMo on USY bound with alumina catalyst 612. The resultant product stream 613 is product stream 505 of FIG. 5. The product 613 was vacuum distilled to take 95 vol % overhead. The distillate contained in the 650−° F. (343−° C.) fraction contained very close to 15 ppm sulfur enabling use of this stream as ULSD.

Figure 7:
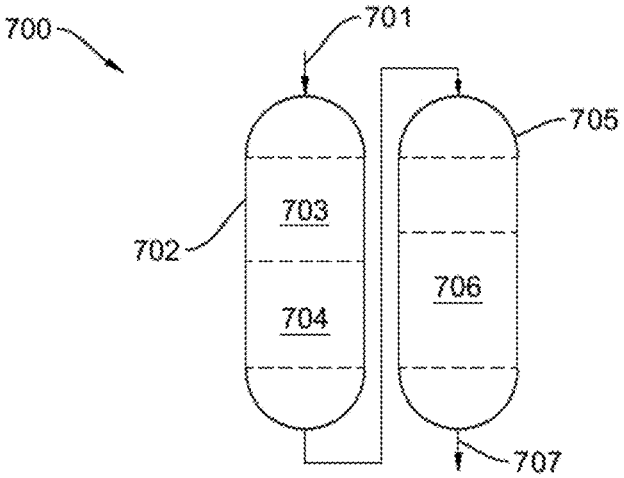
FIG. 7 illustrates the catalyst bed design for the second hydrocracking reactor.

FIG. 7 illustrates the catalyst bed design 700 for the second hydrocracking reactor 516. The distillation resid 701 (e.g., 700° F. (371° C.) to 950° F. (510° C.) stream 514 of FIG. 5) are fed into a first catalyst bed 702 containing 45 $cm^3$ of medium pore sulfided NiMo on alumina hydrotreating catalyst 703 stacked on 30 $cm^3$ of sulfide noble metal hydrotreating catalyst 705. The material is then passed through a second catalyst bed 705 containing 75 $cm^3$ of a Pt on USY noble metal hydrocracking catalyst 706. The resultant product stream 707 is the recycle stream 517 of FIG. 5. The conditions in the second catalyst bed 705 were 420° C., 2850 psig, 12,000 SCFB hydrogen co-feed, and 0.25 LHSV. At these conditions, the reactor product 707 had 200 ppm sulfur. It is believed that it would be practical to hold the reactor at 200 ppm sulfur at 0.20 LHSV for more than a year. Surprisingly, the catalyst was stable within experimental error at the following conditions where extinction recycle hydrocracking was demonstrated at 2850 psig, 0.3 LHSV, 382 C, 12,000 SCFB hydrogen circulation, and 1:1 recycle to fresh feed ratio.

The reaction consumed close to 5000 SCFB of hydrogen across both stages. The liquid product (LPG (0.55 g/cc)+Gasoline (0.77 g/cc, <1 ppm S)+ULSD (0.91 g/cc, 5-10 ppm sulfur) was 138 vol % of the feed. The stage 2 hydrocracker gasoline was 2 wt % aromatics, 86 wt % naphthenes, and 12 wt % paraffins+isoparaffins. The stage 2 full range ULSD was 3 wt % paraffins+isoparaffins, 77% naphthenes, and 20 wt % aromatics. The 650+° F. (343+° C.) tail of the stage 2 ULSD was enriched in aromatics (60 wt % saturates/40 wt % aromatics). The 650−° F. (343−° C.) products were comprised of 10 wt % paraffins, 85 wt % naphthenes, and 5 wt % aromatics. Table 4 includes the amount compositions of the various streams where reference numbers refer to FIG. 5.

TABLE 4

| Stream | kg | Composition |
|---|---|---|
| hydrogen stream 501 | 4 | |
| main column bottoms stream 502 | 100 | 7.2 wt % H<br>3 wt % S<br>10 wt % 1000+° F. (538+° C.)<br>3.4 wt % MCR<br>80 wt % aromatic |
| overheads stream 507 | 99 | 40 kg 700° F.-950° F. (371° C.-510° C.)<br>balance 700−° F. (371−° C.) and $H_2S$ |
| 950+° F. (510+° C.) stream 508 | 5 | 9.5 wt % H<br>700 ppm S |
| $H_2S$ stream 510 | 3 | |
| $C_{4-}$ paraffin stream 511 | 4 | |
| gasoline stream 512 | 32 | |
| ULSD stream 513 | 62 | |
| 700° F. (371° C.) to 950° F. (510° C.) stream 514 | 80 | |
| hydrogen stream 515 | 2 | |
| recycle stream 517 | 82 | $C_1$−950° F. ($C_1$−510° C.) |

Example 5

A main columns bottom (MCB) was produced with the following properties: 1.16 g/cc density; 2.83 wt % sulfur; 0.19 wt % nitrogen; 12 wt % micro carbon residue; 3.4 wt % n-heptane insolubles; 7.56 wt % hydrogen; 67 cSt viscosity at 80° C.; 20 cSt viscosity at 105° C.; and simulated distillation values for T10 of 680° F. (360° C.), T50 of 784° F. (418° C.), T90 of 973° F. (522° C.), and 7 wt % 1050+OF (566+° C.). With the high micro carbon residue value, this feed is considered a high coking feedstock. No solvent was used in this example.

A standard fixed bed reactor with a stacked catalyst bed was used for hydrocracking. The stacked catalyst bed was 68 vol % lightly crushed extrudates of high activity, medium pore sulfide NiMo on alumina hydrotreating catalyst stacked on top of 18 vol % lightly crushed extrudates of noble metal hydrotreating catalyst stacked on top of 14 vol % a sulfided NiMo on USY bound with alumina. The MCB blend was hydrocracked at the following conditions: 420° C.; 2850 psig; 12,000 standard cubic feet per barrel (SCFB) hydrogen co-feed; and 0.25 LHSV total (0.37 LHSV DN-3651; 1.39 LHSV sulfide noble metal catalyst; 1.79 LHSV ZFX).

The reaction consumed 4400 SCFB of hydrogen. The liquid product (LPG (0.55 g/cc)+Gasoline (0.77 g/cc)+ULSD (0.88 g/cc)+naphthenic base stock (0.94 g/cc)) was 132 vol % of the feed. The reactor divided the product into three buckets with the following yields: 10 wt % gas (3 wt % $H_2S$; 5 wt % $C_{4-}$ paraffins; 2 wt % $C_{4+}$ paraffins); 22.5 wt % light liquids (0.795 g/cc density; less than 5 ppm nitrogen plus sulfur; simulated distillation values for T10 of 197° F. (92° C.), T50 of 287.0° F. (142° C.), T90 of 450.4° F. (232.4° C.); and 67.5 wt % heavy liquids (0.934 g/cc density; 40 ppm sulfur; 7 ppm nitrogen; simulated distillation values for T10 of 397° F. (203° C.), T50 of 592° F. (311° C.), T90 of 796° F. (424° C.)).

The combined liquids of the product were distilled into 16 wt % 50° F. (10° C.) to 400° F. (204° C.) gasoline (0.77 g/cc density; <2 ppm nitrogen plus sulfur), 66.5 wt % 400° F. (204° C.) to 700° F. (371° C.) ULSD (0.88 g/cc density; 5 ppm sulfur), and 16 wt % of 700° F. (371° C.) to 950° F. (510° C.) naphthenic basestock (0.98 g/cc density; 180 ppm sulfur; 30 ppm nitrogen).

The greater than 170° F. (77° C.) fraction of gasoline was analyzed via gas chromatography (results in Table 5). The simulated distillation values were T10 of 216° F. (102° C.), T50 of 266° F. (130° C.), and a T90 of 325° F. (163° C.).

TABLE 5

| Compound | Wt % |
|---|---|
| n-butane | 0.0022 |
| 2-methylbutane (iso-pentane) | 0.0406 |
| n-pentane | 0.0956 |
| 2-methyl-2-butene | 0.0010 |
| 2,2-dimethylbutane | 0.0020 |
| cyclopentane | 0.0712 |
| 2,3-dimethylbutane | 0.0441 |
| 2-methylpentane | 0.3715 |
| 3-methylpentane | 0.3162 |
| 2-methyl-1-pentene | 0.0022 |
| 1-hexene | 0.0019 |
| n-hexane | 0.8014 |
| trans-3-hexene | 0.0014 |
| trans-2-hexene | 0.0028 |
| 2-methyl-2-pentene | 0.0029 |
| 3-methyl-cis-2-pentene | 0.0016 |
| cis-2-hexene | 0.0017 |
| 3-methyl-trans-2-pentene | 0.0030 |
| 2,2-dimethylpentane | 0.0067 |
| methylcyclopentane | 2.6035 |
| 2,4-dimethylpentane | 0.0533 |
| 2,2,3-trimethylbutane | 0.0015 |
| 1-methyl-cyclopentene | 0.0021 |
| benzene | 1.2044 |
| 3,3-dimethylpentane | 0.0086 |

TABLE 5-continued

| Compound | Wt % |
|---|---|
| cyclohexane | 5.6317 |
| 4-methyl-1-hexene | 0.0749 |
| 2-methylhexane | 0.6253 |
| 2,3,-dimethylpentane | 0.1517 |
| cyclohexene | 0.1826 |
| 1,1-dimethyl cyclopentane | 0.0143 |
| 3-methylhexane | 0.7494 |
| 1-C-3-dimethyl cyclopentane | 1.7523 |
| 1-T-3-dimethyl cyclopentane | 1.5084 |
| 3-ethylpentane | 0.0493 |
| 1-t-2-diemthyl cyclopentane | 1.4051 |
| c-3-heptene | 0.0023 |
| n-heptane | 0.0170 |
| 3-methyl-cis-2-hexene | 1.2715 |
| 2-methyl-1-hexene | 0.0051 |
| t-3-heptene | 0.0021 |
| c-2-heptene | 0.0048 |
| 3-methyl-trans-3-hexene | 0.0029 |
| 2,2-dimethylhexane | 0.0037 |
| methylcyclohexane | 23.2152 |
| 2,5-dimethylhexane | 4.3879 |
| 2,4-dimethylhexane | 0.1644 |
| 2,3,4-trimethylpentane | 0.0443 |
| toluene | 9.2535 |
| 2,3-dimethylhexane | 0.3304 |
| 2-methyl-3-ethylpentane | 0.0536 |
| 2-methylheptane | 0.6385 |
| 4-methylheptane | 0.2345 |
| 3,3-dimethylhexane | 0.0462 |
| 3-methylheptane | 0.6123 |
| 3-ethylhexane | 6.2739 |
| 1-methyl-trans-3-ethylcyclopentane | 2.4845 |
| 1,cis-4-dimethylcyclohexane | 2.0674 |
| 1-methyl-trans-2-ethylcyclopentane | 1.3374 |
| 2,2,4-trimethylhexane | 0.1964 |
| n-octane | 2.3862 |
| 2,2-dimethyheptane | 1.1137 |
| 2,4-dimethylheptane | 0.0205 |
| 2,5-dimethylheptane | 0.2386 |
| 3,3-dimethylheptane | 0.3500 |
| Ethylbenzene | 3.4533 |
| 2,3-dimethylheptane | 1.2160 |
| p + m-xylene | 6.2123 |
| 1,2-dimethylbenzene (o-xylene) | 4.3648 |
| isopropylbenzene (cumene) | 0.2790 |
| n-propylbenzene | 2.3071 |
| 1-methyl-3-ethylbenzene | 2.3375 |
| 1-methyl-4-ethylbenzene | 1.2449 |
| 1,3,5-trimethylbenzene | 0.3531 |
| 1-methyl-2-ethylbenzene | 0.8418 |
| 1,2,4-trimethylbenzene | 0.8845 |
| isobutylbenzene | 0.4069 |
| sec-butylbenzene | 0.1599 |
| 1,2,3-trimethylbenzene | 0.3447 |
| indane | 0.2035 |
| 1,3-diethylbenzene | 0.1884 |
| 1-methyl-3-n-propylbenzene | 0.1592 |
| 1,4-diethylbenzene | 0.0897 |
| n-butylbenzene | 0.0882 |
| 1,2-diethylbenzene | 0.0184 |
| 1-methyl-2-n-propylbenzene | 0.0633 |
| 1,4-dimethyl-2-ethylbenzene | 0.0438 |
| l,3-dimethyl-4-ethylbenzene | 0.0318 |
| 1,2-deimethyl-4-ethylbenzene | 0.0451 |
| 2-m-indane | 0.0226 |
| 1,2-dimethyl-3-ethylbenzene | 0.0260 |
| 1,2,4,5-tetramethylbenzene (durene) | 0.0119 |
| 1,2,3,5-tetramethyl-benzene | 0.0192 |
| 1,2,3,4-tetramethyl-benzene | 0.0054 |
| Naphthalene | 0.0022 |
| pentamethylbenzene | 0.0032 |
| 2-methylnaphthalene | 0.0057 |
| 1-methylnaphthalene | 0.0043 |
| 1-ethylnaphthalene | 0.0025 |
| 2,6-dimethylnaphthalene | 0.0024 |
| 1,3 + 1,7-dimethylnaphthalene | 0.0016 |
| 2,3 + 1,4-dimethylnaphthalene | 0.0019 |
| 1,5-dimethylnaphthalene | 0.0028 |
| 1,2-dimethylnaphthalene | 0.0024 |
| 1,8-dimethylnaphthalene | 0.0020 |

The 700° F. (371° C.) to 950° F. (510° C.) naphthenic basestock fraction was analyzed by liquid chromatography and produced the following composition: 1 wt % paraffins+isoparaffins+1-ring naphthenes; 24 wt % 2-8 ring naphthenes (mostly 4-6 ring naphthenes); 13 wt % 1-ring aromatics (mostly 4-6 ring napthenoaromatics); 15 wt % 2-ring aromatics (mostly 4-6 ring naphthenoaromatics); 18 wt % 3-ring aromatics (mostly 4-6 ring naphthenoaromatics); and 29 wt % 4+ ring PNA. Accordingly, this fraction may be useful as a napthenic basestock, solvent, rubber blending oil, resin, and the like. The sulfur and nitrogen were concentrated in the 900+° F. (482+° C.) tail. By excluding this tail, the sulfur and nitrogen are low enough that the product could be directly hydrogenated with noble metal catalysts.

The 400° F. (204° C.) to 700° F. (371° C.) ULSD fraction was further analyzed by liquid chromatography and produced the following composition: 2 wt % paraffins+isoparaffins+1-ring naphthenes; 76 wt % 2+ ring naphthenes; 11 wt % 1 ring aromatics (mostly 2-4 ring naphthenoaromatics; 7 wt % 2 ring aromatics; and 4 wt % 3+ ring aromatics. Accordingly, this fraction may be useful as a napthenic basestock, solvent, transformer oil, and the like. This fraction has less than 3 ppm combined sulfur and nitrogen. Accordingly, this fraction could be directly hydrogenated with noble metal catalysts.

The 650−° F. (343−° C.) hydrocarbon products from this example were comprised of 10 wt % paraffins, 65% naphthenes, and 25 wt % aromatics.

Example 4

Figure 8A:
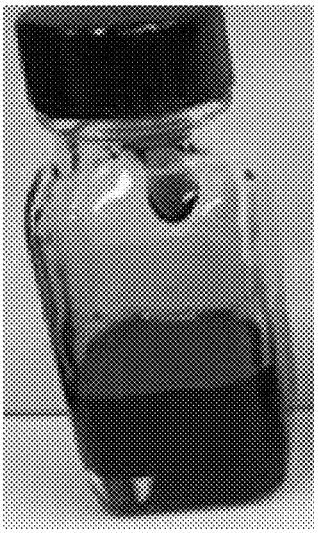
FIGS. 8A-8C are photographs of fractions produced according to the processes of the present invention.

The MCB from a hydrotreating operation were used in combination with hydrogen and passed through a hydrocracking reactor with a noble metal hydrotreating catalyst. The feed had 297 ppm sulfur, 144 ppm nitrogen, 14.3 cSt viscosity at 100° C., and 2306 mmol/kg total aromatics of which 749 mmol/kg was 3+ ring aromatics. After hydrotreating the product had 28.3 ppm sulfur, 17.7 ppm nitrogen, and 1391 mmol/kg total aromatics of which 409 mmol/kg was 3+ ring aromatics. The product was distilled into four fractions: naphtha fraction, distillate fraction, 750° F. (399° C.) to 1050° F. (566° C.) fraction, and 1050+° F. (566+° C.) fraction. FIG. 8A is a photograph of the 750° F. (399° C.) to 1050° F. (566° C.) fraction showing a thick and dark fluid.

Figure 8B:
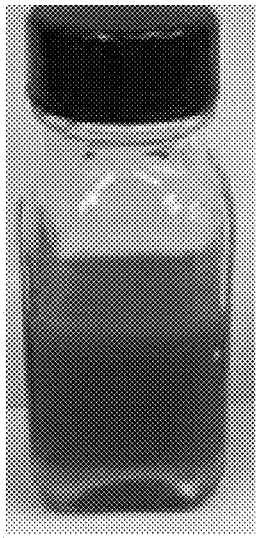
Figure 8C:
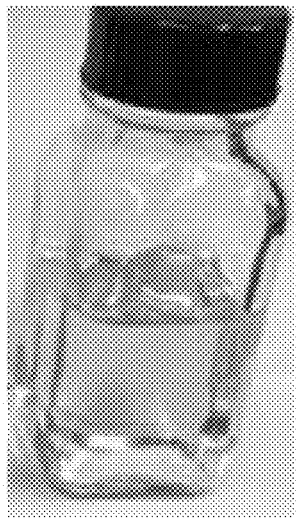

The 750° F. (399° C.) to 1050° F. (566° C.) fraction was further hydrotreated with additional hydrogen to produce the product in the FIG. 8B photograph, which is a lower viscosity than the 750° F. (399° C.) to 1050° F. (566° C.) fraction. This product was then treated with the Arosat process and distilled into two fractions: a 700−° F. (371−° C.) fraction and a 700+° F. (371+° C.) fraction. FIG. 8C is a photograph of the 700+° F. (371+° C.) fraction, which is low viscosity and clear with a 9 cSt viscosity at 100° C. that can be used as basestock.

The distillate fraction was similarly hydrotreated and distilled into four fractions: transformer oil, traction fluid, EV/HV oil, and bottoms. The various fractions have the properties provided in Table 6.

TABLE 6

| Property | Distillate Fraction | Transformer Oil | Traction Fluid | EV/HV Oil |
|---|---|---|---|---|
| API Specific Gravity | 16.7 | 22.4 | 21.3 | 21.0 |
| Sulfur (wppm) | 22 | 0.4 | 0.3 | |
| Viscosity at 100° C. (cSt) | 2.99 | 2.40 | 3.13 | 3.93 |
| VI | −50.6 | 26.3 | −22.3 | −56 |
| PP (° C.) | −36 | −48 | −36 | |
| Paraffins (wt %) | 1.5 | 1.3 | 1.6 | |
| 1-Ring Naphthalenes (wt %) | 1.0 | 1.5 | 1.5 | |
| 2+-Ring Naphthalenes (wt %) | 43 | 95 | 93 | |
| 1-Ring Aromatics (wt %) | 37 | 1.7 | 3.2 | |
| 2-Ring Aromatics (wt %) | 10 | 0.3 | 0.4 | |
| 3+-Ring Aromatics (wt %) | 6.6 | 0.4 | 0.3 | |

Example 6

A main columns bottom (MCB) was produced having the following properties: 1.16 g/cc density; 2.83 wt % sulfur; 0.19 wt % nitrogen; 12 wt % MCR; 3.4 wt % n-heptane insolubles; 7.56 wt % hydrogen; 67 cSt viscosity at 80° C.; 20 cSt viscosity at 105° C.; and simulated distillation values for T10 of 680° F. (360° C.), T50 of 784° F. (418° C.), T90 of 973° F. (522° C.), and 7 wt % 1050+OF (566+° C.).

A standard fixed bed reactor was loaded with 86 vol % lightly crushed extrudates of high activity, medium pore sulfide NiMo on alumina hydrotreating catalyst stacked on top of 14 vol % sulfided NiMo on USY bound with alumina. The MCB blend was hydrocracked at the following conditions: 420° C.; 2450 psig; 12,000 SCFB hydrogen co-feed; and 0.25 LHSV.

The reaction consumed 3000 SCFB of hydrogen. The liquid product (LPG (0.55 g/cc)+Gasoline (0.77 g/cc)+ULSD (0.95 g/cc)+naphthenic base stock (1.02 g/cc)) was 117 vol % of the feed. The reactor divided the product into three buckets: (1) 7 wt % gas (3 wt % $H_2S$, 3 wt % $C_{4-}$ paraffins, and 1 wt % $C_{4+}$ paraffins), (2) 5 wt % light liquids (0.84 g/cc density, <5 ppm combined nitrogen and sulfur, and simulated distillation values for T10 of 197° F. (92° C.), T50 of 287° F. (142° C.), T90 of 450° F. (232° C.)), and (3) 88 wt % heavy liquids (0.98 g/cc density, 150 ppm sulfur, 100 ppm nitrogen, and simulated distillation values for T10 of 397° F. (203° C.), T50 of 650° F. (343° C.), T90 of 930° F. (499° C.)). The products of this reaction boiling below 650° F. (343° C.) were close to 6 wt % paraffins, 54 wt % naphthenes, and 40 wt % aromatics. The products of this reaction boiling below 650° F. (343° C.) were close to 6 wt % paraffins, 54 wt % naphthenes, and 40 wt % aromatics.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

hydrocracking a polynucleararomatic hydrocarbon (PNA) feed in the presence of hydrogen and a base metal catalyst at 380° C. to 430° C., 2500 psig or greater, and 0.1 $hr^{-1}$ to 5 $hr^{-1}$ liquid hourly space velocity (LSHV), wherein the weight ratio of PNA feed to hydrogen is 30:1 to 10:1, wherein the PNA feed comprises 25 wt % or less of hydrocarbons having a boiling point of 700° F. (371° C.) or less and 2 wt % or greater sulfur and having an aromatic content of 50 wt % or greater to form a first product;

separating the first product into an overheads stream and a 950+° F. (510° C.) bottoms stream, wherein the overheads stream comprises 50 wt % or greater of the hydrocarbons having a boiling point of 700° F. (371° C.) or less and having an aromatic content of 20 wt % or less;

distilling the overheads stream into a 700+° F. (371+° C.) boiling point stream having less than 15 ppm sulfur and one or more fractions selected from the group consisting of: a $C_{4-}$ paraffin stream comprising less than 15 ppm sulfur, a naphtha fraction having less than 15 ppm sulfur, and a distillate fraction having less than 15 ppm sulfur;

hydrocracking the 700+° F. (371+° C.) boiling point stream in the presence of hydrogen and a noble metal catalyst to form a second product; and recycling the second product to mix the second product and the overheads before distillation.

2. The method of claim 1, wherein hydrocracking the 700+° F. (371+° C.) boiling point stream includes passing the 700+° F. (371+° C.) boiling point stream and hydrogen over a base metal catalyst and then over the noble metal catalyst.

3. The method of claim 1, wherein the aromatic content of the PNA feed is 70 wt % or greater.

4. The method of claim 1, wherein the PNA feed is selected from the group consisting of steam cracker tar, FCC main column bottoms (MCB) (the 650+° F. (343+° C.) distillation bottoms produced from refinery fluid catalytic crackers), coal tar (the 400+° F. (204+° C.) distillation bottoms produced from steel industry coke ovens), and heavy oil tar (the 900+° F. (482+° C.) bottoms produced by vacuum distillation of heavy oil.

5. The method of claim 1, wherein the PNA feed has a $S_{BN}$ of greater than 135 and an $I_N$ of greater than 100.

6. The method of claim 1, wherein the hydrocracking of the PNA feed is in the presence of the base metal catalyst, the hydrogen, and a solvent.

7. The method of claim 6, wherein the solvent has a $S_{BN}$ of 50 to 200 and an $I_N$ less than 10.

8. The method of claim 6, wherein the solvent is selected from the group consisting of 400° F. (204° C.) to 750° F. (399° C.) boiling point hydrocarbons, light cycle oils, and a combination thereof.

9. The method of claim 1, wherein the hydrocracking converts 75 wt % or greater of 3-ring aromatics in the PNA feed to saturates.

10. The method of claim 1, wherein the hydrocracking converts 90 wt % or greater of 3-ring aromatics in the PNA feed to saturates.

* * * * *